United States Patent [19]

Lohrey et al.

[11] Patent Number: 4,803,348

[45] Date of Patent: Feb. 7, 1989

[54] AUTOMATED CUSTOMER INTERFACE FOR SERVICES INVOLVING DROP-OFF AND PICKUP

[76] Inventors: David W. Lohrey, 339 Golden Gate Ave., Belvedere, Calif. 94920; Alexander R. Danel, 660 Berkeley Ave., Menlo Park, Calif. 94025

[21] Appl. No.: 68,198

[22] Filed: Jun. 30, 1987

[51] Int. Cl.[4] ..... G06K 5/00

[52] U.S. Cl. ..... 235/381; 379/91; 235/383; 235/385; 340/825.35

[58] Field of Search ..... 235/381, 380, 383, 385; 340/825.35; 379/91, 144; 364/401, 403

[56] References Cited

U.S. PATENT DOCUMENTS

| | | | |
|---|---|---|---|
| 4,300,040 | 11/1981 | Gould et al. | 235/381 |
| 4,359,631 | 11/1982 | Lockwood et al. | 235/381 |
| 4,414,467 | 11/1983 | Gould et al. | 235/381 |
| 4,550,246 | 10/1985 | Markman | 235/385 |
| 4,553,211 | 11/1985 | Kawasaki et al. | 364/479 |
| 4,567,359 | 1/1986 | Lockwood | 235/381 |
| 4,575,719 | 3/1986 | Bertagna et al. | 340/825.35 |
| 4,579,213 | 4/1986 | Rhine et al. | 194/217 |
| 4,598,810 | 7/1986 | Shore et al. | 194/205 |
| 4,675,515 | 6/1987 | Lucepo | 235/381 |
| 4,734,858 | 3/1988 | Schlafly | 364/408 |
| 4,752,876 | 6/1988 | Couch et al. | 364/407 |
| 4,758,714 | 7/1988 | Carlson et al. | 235/380 |

FOREIGN PATENT DOCUMENTS

| | | |
|---|---|---|
| 1107988 | 3/1968 | United Kingdom . |
| 1316453 | 5/1973 | United Kingdom . |
| 1317306 | 5/1973 | United Kingdom . |
| 1423135 | 1/1976 | United Kingdom . |
| 1604040 | 12/1981 | United Kingdom . |

*Primary Examiner*—Robert Lev
*Attorney, Agent, or Firm*—Thomas M. Freiburger

[57] ABSTRACT

A system for automated, attendant-free customer interface for services such as laundry and dry cleaning processing or rental of items such as videotapes enables customers to order services and pick up processed orders using a general purpose, undedicated credit card. A retrieval device upon appropriate command retrieves a customer's processed order and brings it to a customer interface panel door, which opens to enable the customer to pick up his processed order. Included in the customer interface panel are a card reader for reading the customer's credit card, a display for presenting information and instructions to the customer, a menu of services for selection by the customer and a keyboard or other input device to select desired services. A printer is included for printing a receipt and/or a transaction record. The system includes a computer at each remote machine facility outlet for handling functions associated with the credit card reader, instructing the retrieval device to retrieve orders, for operating a display, for handling the customer input device, and for creating a transaction record. The general purpose computer can also provide for networking between the central plant and a larger number of remote automated customer interface facilities, and a telephone, modem and auto dialer preferably are included at each automated facility for computer communication with the central plant.

39 Claims, 10 Drawing Sheets

TRANSACTION RECORD

68

CUSTOMER CREDIT CARD NO.
DATE / TIME / OUTLET NO. ( UNIQUE KEY )
BAG NO.
TYPE OF TRANSACTION ( DROP - OFF OR PICKUP )
LISTING OF GARMENTS / SERVICES INPUT BY CUSTOMER

FIG. 6A

IDLE STATUS

Internal error checking
- if trouble
report it through network, to central plant;
display trouble message Normal greeting
-screen shows greeting message, i.e.
"Hello, insert your credit card for a menu of available selections."
-system monitors credit card reader for activity
-other inputs on user interface panel are deactivated

CARD READER ACTIVE

Check Integrity of bytes read
-If corrupted, display message instructing customer to
"try again."

Card identification legible
-All inputs on User Interface Panel are activated
-Screen displays prompt urging user to select from
menu selections; i.e. "(1) Pickup; (2) Drop-off; (3) Finished...
Please make a selection."

"PICKUP" SELECTED

Processor scans the completed orders, selecting those belonging
to the card owner.
Item handler retrieves those orders
Sequence ends with front door open, order available to customer,
and inner door shut.
Front door shuts after time-out or user keypress.

"DROP-OFF" SELECTED

Customer prompted to use keyboard to indicate item description.
Further descriptions received till customer indicates "no more."
Front door opens, inner door is shut, customer prompted to
"insert goods and press any key when ready."

Front door shuts, inner door opens, item handler moves goods to
drop-off area.
Transaction Receipt is printed.

FIG. 6B

"FINISHED" SELECTED

Return to Idle Status sequence

ITEM HANDLER ACTIVITY

According to command received, initiate appropriate mechanical process cycle.
mechanical process cycle
-power to motors and servos
-monitor sensors and comparator feedback
-logic control
Cycle completed by returning a control code or signal
Example: to retrieve from position 123:
---receive bytes presenting ASCII "R", "123", ASCII "Escape"

FRONT DOOR CLOSES, INNER DOOR OPENS

-gantry motor activated, position counting sensors monitored
-comparator indicates position 123 reached, stop gantry
-activate item pick-off servo
-move gantry to "home" position, in kiosk
-close inner door, open front door
-return to completion code

VENDOR ACTIVITY - ROUTEMAN

Items dropped off by customers have accumulated in storage area.
Truck driver gains special access to storage area.
Driver delivers completed order to appropriate locations in machine, for later automated pickup.
Driver can request position information from local computer.
Driver removes drop-off items from storage area, to truck, for processing at central plant.
Driver exchanges print-out or disk, as appropriate.
Driver locks out special access.

VENDOR ACTIVITY -- CENTRAL PLANT

Actual contents of drop-off are compared with the included or downloaded transaction record.
Transaction adjustments are made, if necessary.
Billing adjustments made.
The processing of the order is executed.
Completed orders loaded onto truck.

AUTOMATED CUSTOMER INTERFACE FOR SERVICES INVOLVING DROP-OFF AND PICKUP

BACKGROUND OF THE INVENTION

The invention relates to automated customer interface in the provision of retail services, and more particularly to a method and system for providing services such as laundry/dry cleaning services, photoprocessing services, shoe shine and repair services, video rental and similar services using a network of attendant-free kiosk-like automated machine facilities at which a customer drops off an order and later picks up the processed order ordinarily without the necessity of any human interface. The invention relates to the use of a customer's general purpose, undedicated charge card for identifying the customer's order and for automatic billing of the customer for services.

Laundry and cleaning drop-off and pickup facilities having some degree of automated operation have been known prior to the present invention. For example, automated drop-off and pickup facilities (sometimes attended and sometimes unattended) principally for limited associated groups as in uniform cleaning services in hospitals for use with dedicated cards or "club cards" held by members of the limited group, are described in a series of British patents: Nos. 1,107,988; 1,316,453; 1,317,306; 1,423,135; 1,604,040; and 2,080,264.

The above-listed patents disclose a mechanical garment retrieval system or "gantry" system which can be used in the system of the present invention. The patents also disclose the use of a computer, connected to a keyboard, display and printer, as well as to a card reader and a control for the mechanical retrieval and door-operating functions of the system, but the use of the computer is extremely limited. Array lookup is utilized in conjunction with the card or token reader to locate a storage position with a customer's processed order, or to find an available storage position for a new order, and the present invention can employ something similar to this as one limited aspect of customer order handling.

The British patents disclose systems only for use with dedicated or "club" cards held by members of a closed, limited group—tokens or punched cards, for example, can be used to represent the customer and sometimes an account balance. Unlike the present invention, the systems disclosed in the British patents do not permit the use of a general purpose, undedicated charge card such as MasterCard or Visa for identifying a customer and for triggering the taking of an order or the completion of an order by automatic delivery of serviced goods to the customer. Thus, the systems of the British patents cannot be used for general retail services for handling the order of any customer approaching an automated machine facility, previously unknown to the system.

Further, the systems of the British patents do not disclose interactive customer interface with the order processing system. A keyboard disclosed in British Patent No. 2,080,264 is for use by an attendant of the facility, not a customer. Thus, in the disclosed systems there is no provision for a customer to select from a menu of services and to input an order for a variety of different requested services, reflecting a variety of different items the customer drops off (or picks up) at the facility.

Further, the systems disclosed in the prior patents did not take advantage of computer networking for the transfer of information relating to orders and transaction records generated at a number of remote facilities, for communicating information to a central plant. In fact, the prior systems did not include the generation of a transaction record, identified by a transaction number (or other unique identification) for each order taken from a customer, with each transaction record being useful for (a) providing a confirmation or temporary receipt for a customer, through the printer, (b) providing a customer order record for receipt by the central plant, for verification against the actual items deposited by the customer, the record being communicable to the central plant either by a printed receipt transported to the plant by a route driver picking up orders or by modem transmission from the automated facility to the central plant, or both, and (c) for storing in memory for reference when the customer returns to pick up a processed order.

In summary, previous systems which have attempted any form of automation in providing customer services efficiently through a series of remote and substantially unattended facilities have not included key elements which form a part of the present invention, and without these key elements the prior systems did not have the capability of functioning as a reliable attendant-free customer interface for retail services, generally in the manner of an automated teller machine.

SUMMARY OF THE INVENTION

It is an object of the present invention to integrate a number of features and concepts to greatly extend the range of customer interfacing and automated provision of retail services as compared to previous systems such as those disclosed in the cited British patents.

In accordance with the present invention a general purpose computer is used to augment the interface between a card reader and a garment retrieval device (or other processed order retrieval or rental item retrieval). The system of the invention is activated by any non-dedicated, general purpose credit card (such as MasterCard or Visa), from any customer whether or not the customer has ever used the system previously. This makes the system adaptable to a wide variety of retail services, not restricted to a group or club holding dedicated cards controlled by the system and solely for this system, and requires no previous registration with the system. It enables the identification of an order by the customer's credit card data (usually contained in a magnetic strip on the credit card), and it enables debiting of the customer's account. It also enables automated verification of credit, or validation of the credit card, prior to the rendering of services.

The invention also involves creation of a transaction record for each transaction taking place at each automated customer interface machine facility. The transaction records are important for tracking of orders and computer processing of orders, as well as for producing customer receipts and customer input records for the central plant and for compiling daily transaction lists and permanent statistical records for each remote automated facility organized as desired.

The use of a general purpose computer is a very important aspect of the invention. The computer is networked with a central computer at the central processing plant; it takes information from the credit card reader to find a processed order or to take a new order; it interacts with the processed order retrieval device; it operates a display for giving customer information and instructions; it receives a customer's interactive input of requested services at the customer interface; it creates the transaction records of all transactions; it may operate a modem and auto-dialup for downloading information to the central plant or for receiving instructions or information from the plant; it may run a disk drive; and it drives one or more printing devices.

Interactive customer interface is a central feature of the present invention. Instead of receiving a token or dedicated card as its only input from a customer, the system of the invention provides for menu selection by the customer and specific listing by the customer of selected services desired with the order. The customer input may be by keyboard, touchscreen, light pen, mouse or other input devices. The system may use an augmented key field, whereby the customer's credit card identification is associated with a transaction key or identifier, which in turn is associated with a garment storage position.

In one aspect of the invention, a system for automated drop-off and pickup of customer servicing orders such as laundry and dry cleaning orders, remote from a central service plant, for unattended use by customers includes a storage facility for garment bags, soiled garments of new orders and processed laundry/dry cleaning orders, and with means for storing garment bags and processed orders in positions for retrieval. A retrieval means is provided in the storage facility for retrieving a garment bag or a processed order upon receipt of an appropriate command.

At the front of the storage facility is a customer interface panel, which includes a credit card reader for reading encoded information on a customer's non-dedicated general purpose credit card, a display, a menu of services displayed to the customer for selection of services in the customer's order, and a customer interactive input means for enabling the customer to select desired services and to list dropped off garments in accordance with the menu of services. The keyboard may itself serve as the menu, with labeled keys.

The customer interface panel preferably includes a telephone means for customer communication with the central plant to handle problems, complaints and special requests, and with a modem and telephone line also useful for networking with the central computer.

The automated machine facility also includes a printer means in the customer interface panel, for printing and outputting to the customer a receipt reflecting the garments dropped off by the customer and the services selected by the customer, as input by the customer. A second printer (or printer output) may be included behind the customer interface panel, for printing compilations of daily transactions or other printouts not intended for the customer.

A door in or adjacent to the customer interface panel opens at appropriate times to allow the customer to drop off an order or to pick up a processed order.

The computer means with memory means receive and store information from the customer's credit card, and issue appropriate instructions to the customer on the display means after receiving this information. The computer also receives the customer's input on the input means and issues a command to the retrieval means if the customer's order has been processed and placed in the storage means, to retrieve the processed order and bring it to the door and open the door to enable the customer to remove his processed order. The computer also creates and stores in memory a transaction record of each transaction, as well as driving the printer(s), and the computer may network through a modem and auto-dialer with a central computer at the central plant.

It is therefore among the objects of the invention to greatly expand the range of functions, the range of services and the range of potential customers for an automated retail services drop-off and pickup facility, principally by employing a general purpose computer as an integral part of customer interfacing and for network communication, in combination with an interactive customer interface and a non-dedicated credit card reader. The method of operating the system including a plurality of remote automated machine facilities serviced by a central control or processing plant also forms an important part of the invention. These and other aspects, objects, advantages and features of the invention will be apparent from the following description of a preferred embodiment, considered along with the accompanying drawings.

DESCRIPTION OF THE DRAWINGS

FIG. 4 also shows the interaction between the control center/central plant and the customer interface facility, both by telephone line and by delivery route.

FIGS. 6, 6A and 6B are schematic routine charts illustrating one example of a routine which may be followed in the system and method of the invention. FIGS. 6A and 6B include customer advice display sequences, customer input, customer drop-off and pickup sequences, collection of orders by a route driver, processing of orders at the central plant, and return of processed orders by the route driver.

DESCRIPTION OF PREFERRED EMBODIMENTS

Figure 1:
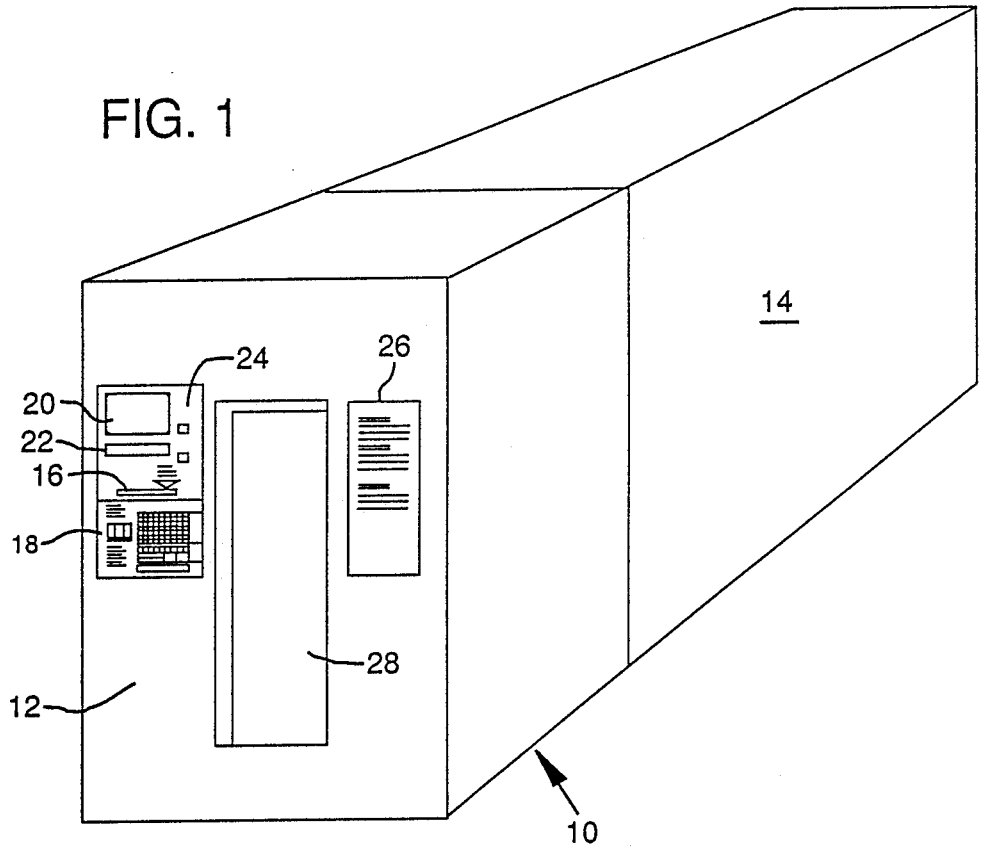
FIG. 1 is a schematic view in perspective, showing an automated customer interface facility with a customer interface panel and a storage facility.

In the drawings, FIG. 1 shows diagrammatically a kiosk-like retail outlet structure 10 with a customer interface panel 12 for interactive interfacing with customers approaching to use the services offered through the outlet 10.

At the rear of the outlet 10 is a storage facility 14, not accessible to the customer, for storing a large number of items such as dropped-off soiled garments of customers and processed orders waiting for retrieval, in the case of the system's use as a laundry/dry cleaning services outlet. Alternatively, or in addition, the system can be used for other services such as shoe shine and repair, film processing, clothing repairs and alterations, rentals such as videotape rentals, and other services which involve both drop-off and pickup of items by a customer, in either order.

The front panel or interactive interface panel 12 of the system includes a credit card reader 16, a customer input device such as a keyboard 18, one or more displays 20 and 22, such as the video screen and dot matrix text display, respectively, shown in FIG. 1, a telephone 24 for communicating with a control center or central processing plant (see also FIG. 2), a set of displayed instructions 26 for initiating operation of the system, and a drop-off and pickup door 28 through which the customer deposits items and removes items.

The instructions 26 can either be printed permanently on the front of the panel 12 as indicated, or they can be displayed sequentially on the video screen 20 (or other display 22) when the machine is inactive to instruct the customer step by step through the procedure for using the automated machine facility outlet 10.

Behind the door 28 is an item retrieval device (not shown in FIG. 1) which upon receipt of an appropriate commands will bring items from the storage facility 14 up to the door, opening the door, or will present the customer with a bag or other container or receptor upon opening the door 28, for his deposit of items such as soiled garments, exposed film, items for repair, or return video rentals. There may be included a second, inner door (not shown) behind the door 28, to hide and secure the storage facility 14 from customers, and the inner door must open first as the retrieval mechanism approaches the customer interface panel, then close as the interface door 28 opens.

The door operation as well as the retrieval system and mechanism do not in themselves form a part of the present invention, and may be of the type disclosed, for example, in the above-listed British patents and the disclosures of those patents are hereby incorporated by reference herein.

Figure 2:
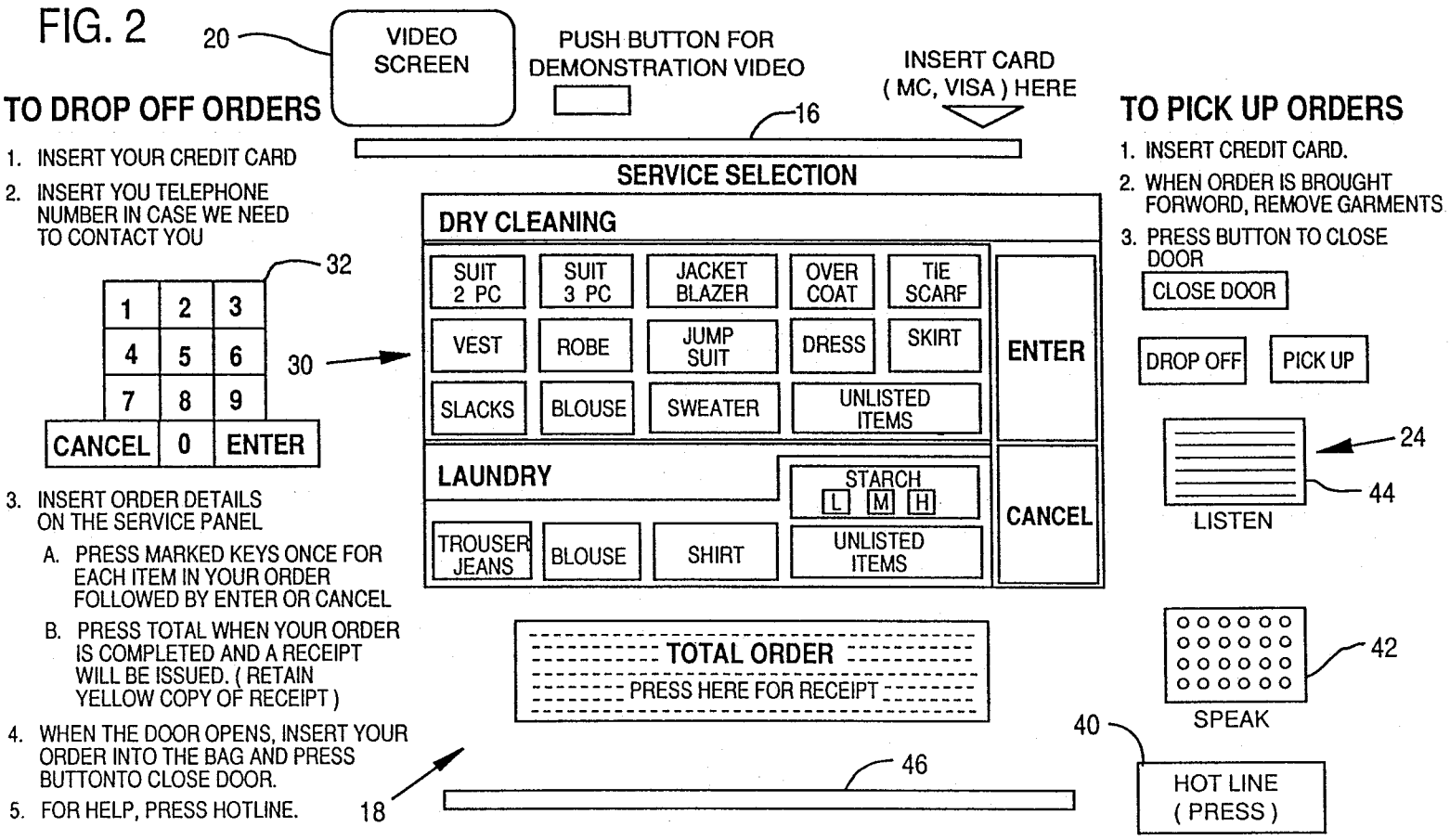
FIG. 2 is a schematically presented front view of a portion of the customer interface panel, showing a keyboard for customer input of a laundry/dry cleaning order.

FIG. 2 shows one example of a portion of the interactive customer interface panel 12 of the automated outlet facility of the invention. This figure shows in particular the keyboard 18, which may comprise a labeled key type keyboard 30 for selection of a wide range of services by pressing appropriate buttons, as well as a numerical keyboard 32. FIG. 2 also indicates diagrammatically a credit card reader insert slot 34, a video screen 20 and a telephone 38 comprising a customer activated button 40, a microphone 42 and a speaker 44, all in the face of the interactive panel 12. The telephone device 38 is dedicated, available only for the customer to call a control center or central processing plant in the event of problems, complaints or special requests in connection with an order. Pressing the "HOT LINE" button 40 activates an auto dial-up behind the panel which dials the central plant.

As indicated at the credit card reader 34 the automated machine facility receives general purpose credit cards, such as MasterCard and Visa, rather than dedicated or "club" type cards wherein a previous membership or registration form is required. The reader 34 may be a magnetic strip reader, for the type of encoding presently used on the backside of credit cards, or it can be an appropriate form of optical reading system, in the event cards are used with that type of encoding.

All of the instructions to the left and right of the keyboard 30 in FIG. 2, i.e. the instructions "TO DROP OFF ORDERS" and "TO PICK UP ORDER", although shown printed on the panel in FIG. 2, may be displayed simultaneously or in sequence on the video screen 20 or on an auxiliary instruction display such as shown at 22 in FIG. 1. If a sequence of instructions are presented, the first instruction will instruct the customer to insert a credit card, followed by (if the credit card is acceptable) an instruction for the customer to select services.

The labeled service selection keyboard 30, as illustrated, provides for a wide range of services selection for the customer, in the dry cleaning and laundry example shown in the drawings. Other items than those shown in FIG. 2 can be specifically listed, and there should be a button for "UNLISTED ITEMS", as shown for both dry cleaning and laundry. Preferably, as the customer pushes buttons to make his selections for services, reflecting the items he will be dropping off, his selections are displayed on the video screen 20 (or on the auxiliary display 22), preferably along with prices (or prices can be on the keyboard or accessible on screen by depressing a "PRICE" button). This enables the customer to see his order before he enters it finally using the "ENTER" button. Thus, he may "CANCEL" the order if mistakes are made prior to the completion of the entry.

When the customer has completed the entry of his order, the machine waits for the activation of the "TOTAL ORDER" button, before finalizing the order and printing the customer a temporary receipt, which may be output through a receipt slot 46. The customer's receipt at this point should be a temporary receipt, so that the central processing plant can manually verify the items deposited against the items listed by the customer, before producing a final order tabulation, billing and receipt. If the actual order varies from what the customer has entered, the central plant personnel can telephone the customer, since the customer has been requested to enter his phone number and this will appear on the receipt or a transaction record of each transaction or it will be communicated electronically to the central plant over a computer modem telephone line link, as further discussed below.

As indicated in the diagrammatic illustration of FIG. 2, the panel preferably includes a pair of buttons labeled "DROP OFF" and "PICK UP", so that the customer can indicate, when requested on the display, whether he is dropping off a new order or picking up (or attempting to pick up) a processed order. This customer interaction avoids possible mistakes or confusion if the customer inserts a different credit card on attempted pickup, or returns the same day after a drop-off with a further drop-off order using the same credit card, etc.

Figure 3:
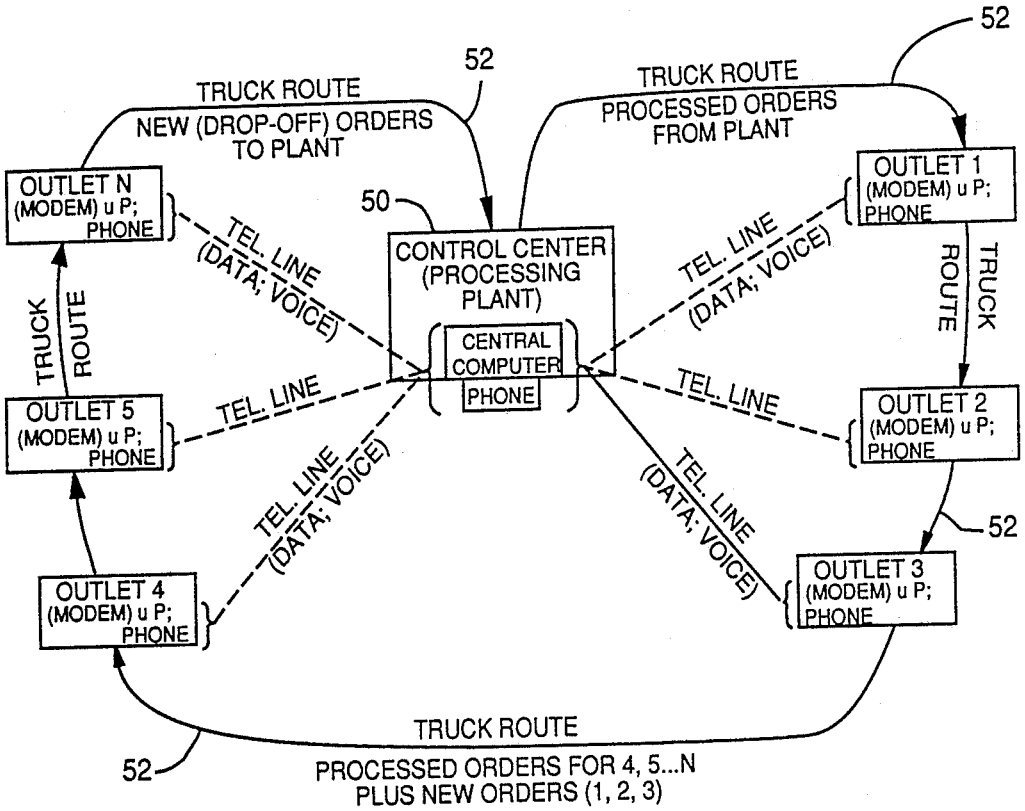
FIG. 3 is a schematic block diagram view showing a network of remote automated customer interface outlets and a control center or central processing plant, in accordance with the system and method of the invention. The remote outlets are shown connected to the central control or plant by telephone links (both modem and voice) and by a truck route for pickup and delivery of customer orders.

FIG. 3 schematically illustrates the network of the system and method of the invention, wherein the system is used for servicing of a customer's goods picked up at remote outlets (1, 2 . . . N) processed at a processing plant or control center 50, and then returned to the respective outlets for pickup by customers.

As pointed out in FIG. 3, the outlets 1, 2, 3, . . . N are connected to the network center, i.e. the processing plant 50 by several links. A manual link is the route driver's truck route 52, by which processed orders are carried from the processing plant 50 to the series of automated customer interface outlets in the network served by this processing plant. As indicated, the route driver's route may efficiently make a circuit of all the remote outlets served by the plant before returning to the plant, or intermediate returns can be made to the plant 50, depending on map location of the various outlets served, volume of orders to be carried, progress of the processing plant in filling all orders, situations where one or more outlets may have no drop off or pickup business on a particular day, and other considerations.

In the routine shown in FIG. 3, the route driver carries processed orders from the plant to Outlet 1 to place customers' processed orders in the storage facility there, while also collecting dropped off orders from Outlet 1. Thus, as the route driver travels from Outlet 1 to Outlet 2, he carries both drop off orders and processed orders for pickup, and at each outlet he places processed orders appropriately for that outlet and gathers all drop off orders for carrying to the central processing plant. As the driver leaves the last outlet (Outlet N) and approached the plant 50, he should be carrying only new drop off orders.

The other links in the network, linking the central processing plant 50 with the various outlets, are via telephone lines. These links provide for both on the spot interaction between a customer and the central plant over voice telephone in the event of questions or problems about an order, and for computer-to-computer communcation of data over modems and the telephone line. The data received at the central plant 50 can include a listing of all transactions in a particular period of time (such as a day), so that the plant can be advised of how much processing work will be required, as in over night processing, downloaded either at a command sent by the plant or automatically from the outlets by time-of-day activation or triggered by a certain volume of business at each outlet.

Data can flow from the central plant to the outlets as well. Such data might include special information to be presented to a particular customer upon re-insertion of his credit card to pick up a processed order such as relating to problems in the order or a problem with validation of a credit card. Also, such data could include special offers, sales or promotions occurring at any of the various at a particular time, displayed on the video screen 20 or the other display 22.

Figures 4, 5:
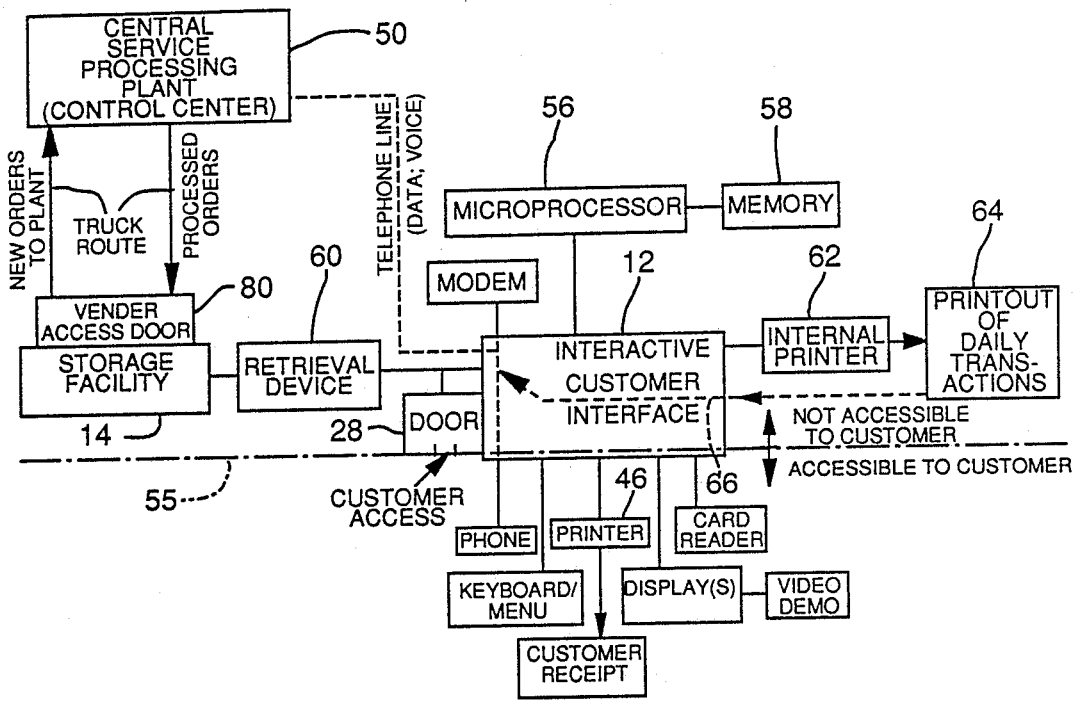
FIG. 4 is a block diagram illustrating components of the system of the invention, particularly of the intractive customer interface and its components accessible to the customer and non-accessible to the customer.
FIG. 5 schematically shows an example of a transaction record which may be generated by the computer of the customer interface facility.

FIG. 4 shows in schematic block diagram form the interactive customer interface 12 of the system of the invention, particularly as it relates to customer-accessible interface components and to non-accessible components, mechanisms and elements which are part of the equipment and services involved in serving the customer. In FIG. 4 a division line 55 is used to show the division between customer interface (accessible) elements and those which are accessible only to service personnel.

As indicated, the customer has access to the display(s) for instruction and information, to a video demonstration tape, to the customer input means which may be a keyboard with a menu (or other type of input such as touchscreen, mouse or light pen), the card reader, the telephone and the printer, in that the customer can receive a receipt. The customer also has access to the door 28, when it opens in response to instructions as when the customer's processed order is brought to the customer (and also if a deposit bag, e.g. a garment bag, is dispensed in this way).

FIG. 4 also illustrates the telephone line link between each interactive customer interface outlet and the control center or central service processing plant 50. This connection is both by computer and modem for data, and by voice telephone when necessary, as discussed above.

FIG. 4 also shows a microprocessor 56 and memory 58 included behind the panel 12 at each of the remote outlets (collectively referred to as a computer or computer means herein and in the claims). These and other elements are shows connected to the interactive customer interface 12, and through that interface to other components or peripherals. This does not indicate that any of the components are not linked directly together; the diagram of FIG. 4 is simply to illustrate the association of elements as they are interfaced by the customer interface 12.

Also shown in FIG. 4 are a retrieval device or system 60, connected to the interface 12, to the door 28 and to the storage facility 14 at the automated customer interface outlet. As mentioned above, the retrieval device 60, storage facility 14 and door 28 may, for example, be as disclosed in the above-referenced British patents.

Also illustrated in FIG. 4 is the truck route linkage between each remote outlet's storage facility 14 and the central processing plant 50, for transferring new orders to the plant 50 and delivering processed orders back to the storage facility 14 for pickup by the customer.

FIG. 4 shows an internal printer 62 behind the customer interface panel 12, in addition to the printer 46 used to print customer receipts. A single printer can be used if separate printer outlets are used, one for the customer and one for an internal printout of daily transactions, as indicated at 64 in the drawing. FIG. 4 indicates schematically that the same information of these internal printouts of daily transactions can be transferred electronically by modem over the telephone line to the central plant 50. This transfer of information can alternatively, or in addition, be by the route driver's carrying a printed out list of transactions back to the plant whenever he collects customers' drop-off orders.

Figure 4A:
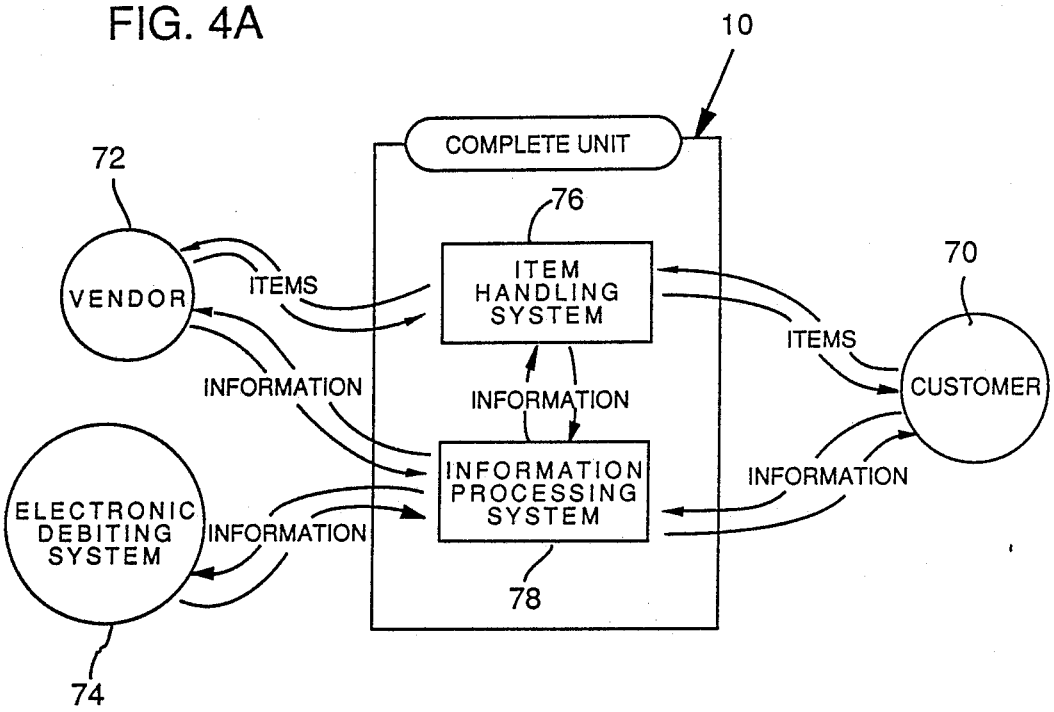
FIG. 4A is a block diagram related to FIG. 4 and showing two distinct types of work flow in the system of the invention—that of goods and that of data. The item handling mechanism can be structured so that its only data communications are with the information handling system.

The block diagram of FIG. 4A shows the flow of items and the flow of information between components of the system, including the components of the automated interfacing unit 10, the customer, indicated at 70, the vendor 72, which may be considered the laundry/dry cleaning firm as represented by the central processing plant 50 in the previous drawings, and an electronic debiting system 74 which may form a part of the invention. An item handling mechanism 76 of the outlet 10, including the retrieval device 60 and the storage facility 14 as shown in FIG. 4, receives instructions from and feeds back information to the information processing system 78, including the microprocessor and memory 56 and 58.

Items or goods flow both ways between the customer 70 and the item handling mechanism 76. Similarly, information flows both ways in this interactive system between the customer 70 and the information processing system 78.

The left side of FIG. 4A illustrates the flow of items between the vendor and the item handling mechanism; and of information between the vendor and the information processing system. Similarly, the flow of information in both direction is illustrated between the information processing system 78 and the electronic debiting system 74, which may be considered to represent access to a credit card service or banking network wherein credit cards are validated for use and through which automatic electronic debiting may be effected.

Figure 4B:
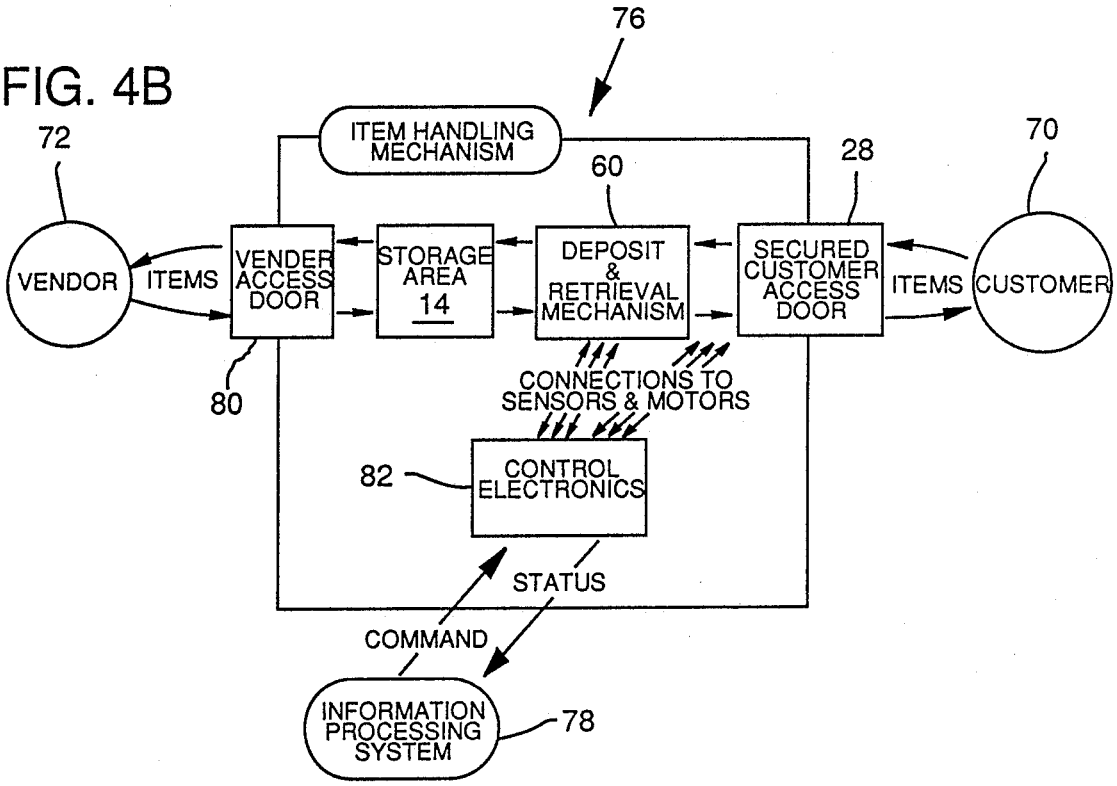
FIG. 4B is another block diagram related to FIG. 4, showing schematically the interface between the item handling mechanism and the information handling system, with simple communications flowing between them.

FIG. 4B, another block diagram relating to the diagram of FIG. 4, is an enlarged and further detailed view of the item handling mechanism 76, also showing its interface with the customer 70 and the vendor 72, as well as with the information processing system 78 as in FIG. 4A. As illustrated, the item handling mechanism includes a vendor access door 80, also shown in FIG. 4, the storage area 14, the deposit and retrieval mechanism 60 (see FIG. 4), the secured customer access door 28 and control electronics 82 of the item handling mechanism. The flow of items as shown in the bidirectional line of flow among elements 72, 80, 14, 60, 28 and 70, while control via sensors and motors is indicated between the control electronics 82 and the deposit/retrieval mechanism 60 and the customer access door 28. Commands flow from the information processing system 78 to the control electronics 82 and status of the various elements flows from the control electronics to the information processing system 78.

Figure 4C:
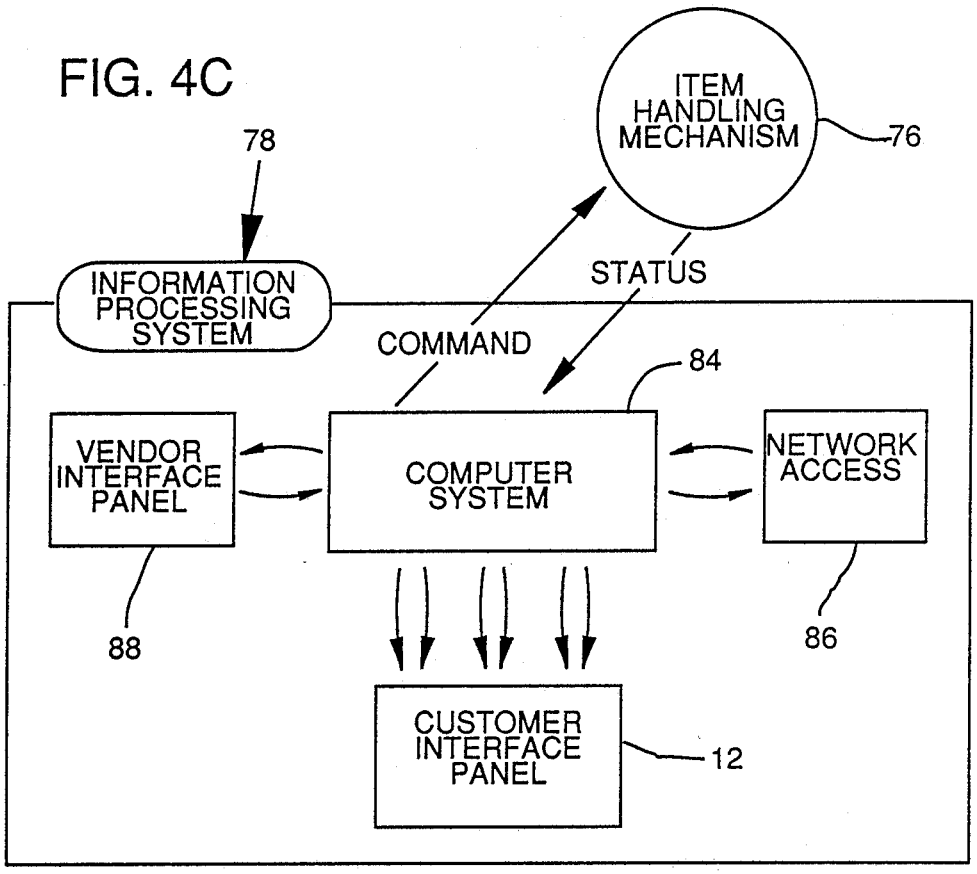
FIG. 4C is a simplified block diagram also related to FIG. 4, showing many types of input and output being handled by a single computer at the automated customer interface facility.

FIG. 4C, also related to FIG. 4, shows input and output being handled by a single computer 84 of the information processing system 78. FIG. 4C shows the computer 84 communicating externally with the item handling mechanism 76 internally with a network access 86 (as for credit card verification or automatic debiting), the customer interface panel 12 and a vendor interface panel 88 which may optionally be included in each remote outlet behind the customer interface panel 12. The vendor interface panel, having at least a keyboard and preferably a display and printer, enables a route driver to enter positions where he has deposited each processed order in the storage facility, so that storage position numbers need not be associated with a customer's order until the processed order is returned. Also, the vendor interface panel can give the driver needed information from time to time, and can enable him to enter special instructions or information for particular customers, which will be displayed or printed on a receipt when the customer picks up his processed order.

Figure 4D:
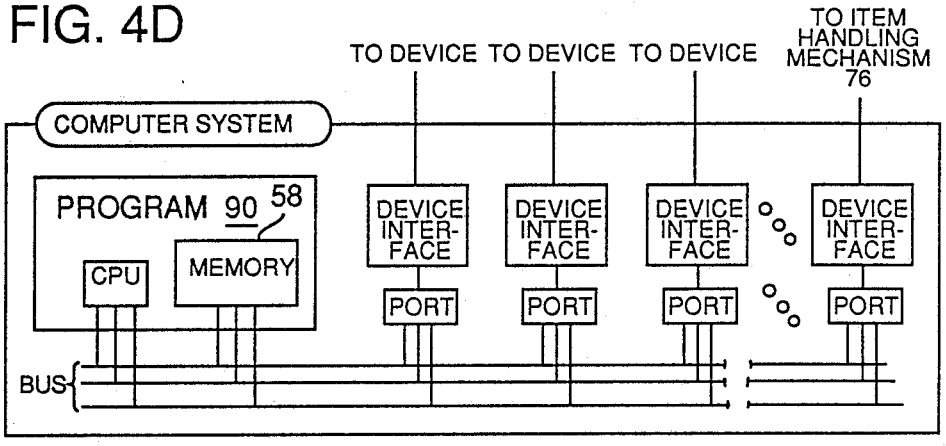
FIG. 4D is a block diagram demonstrating that all fuctions of the automated customer interface facility can be handled by a single computer program, including item handling, communications with and inputs from the customer.
Figure 4E:
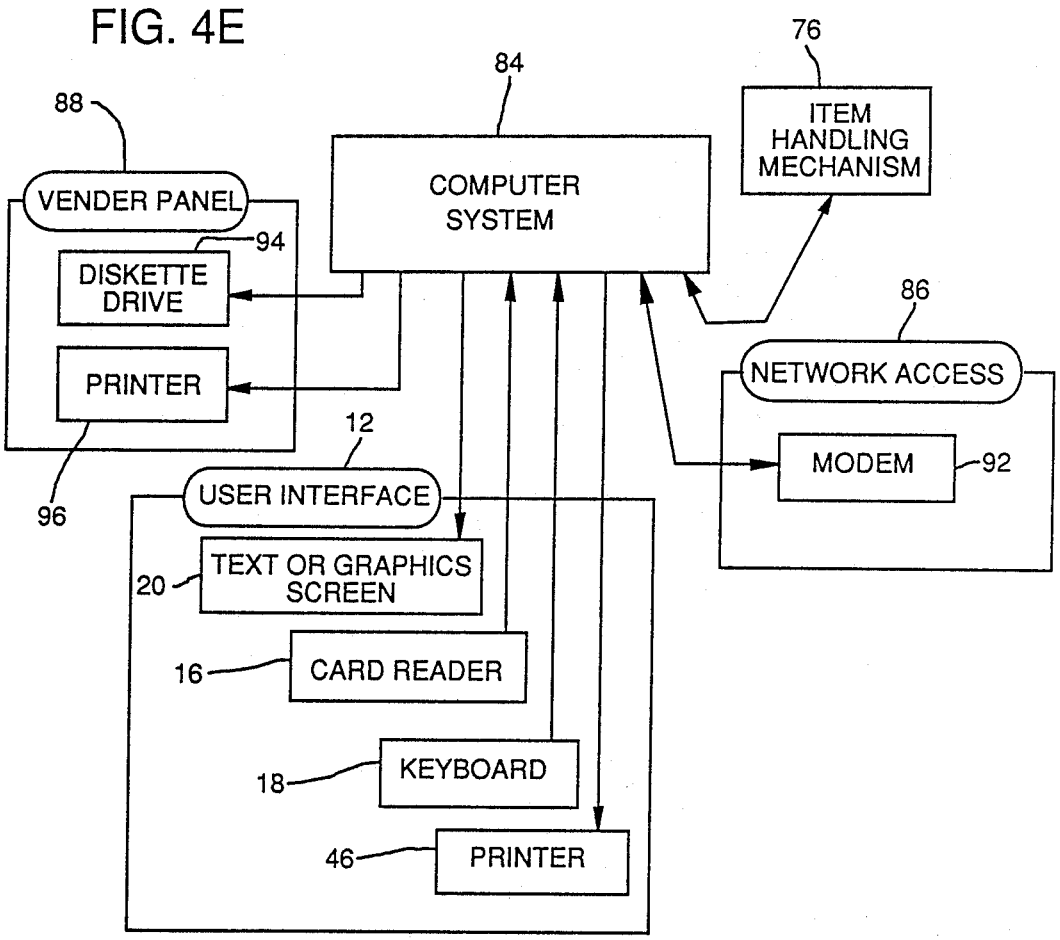
FIG. 4E is another block diagram also related to FIG. 4, showing some of the peripheral devices connected to the computer at each remote customer interface facility.

FIG. 4D shows in block diagram form that, if the item handling mechanism 76 is designed and structured as a peripheral device for connection to a computer, then it can be controlled by the same software program (indicated at 90) that controls the other devices indicated as connected by bus to the computer and its program, e.g. the peripherals shown in FIG. 4E. In this way, different item handling mechanisms can be interchanged with the system, as for updating with improved equipment or for interfacing different types of item handling mechanism, for different items, with the rest of the system. Also, with this arrangement, if the item handling mechanism is in a down mode, the rest of the system is not incapacitated.

FIG. 4E illustrates the interfacing of the computer system 84 with the various peripheral devices to effect the system more generally illustrated in FIG. 4. It shows connection with the item handling mechanism 76, the network access 86 via a modem 92, and the optional vendor interface panel 88 (see FIG. 4C), which may include a diskette drive 94 and a printer 96, as well as a keyboard (not shown) as discussed above.

FIG. 4E also shows interfacing of the computer system 84 with the user interface or customer interface panel 12, including the display 20, the card reader 16, the keyboard 18 and the printer 46.

FIG. 5 illustrates an example of a form of transaction record 68 which may be used to record each transaction with a customer at each of the automated customer interface outlets 10. These transaction records are internal and coded records created by the computer and stored in memory. It may be used for tracking of a customer's order throughout the history of the order, from drop-off to pickup. It may also be used to associate a customer's order with a particular position number in the storage facility 14, as disclosed in the above-referenced British patents, although other means of order position locating may be used, and the position location is not shown specifically in FIG. 5. Such position association with an order can be made from the time of initial input by the customer on drop-off, or it can be initiated later, on return of processed orders to the storage facility 14, with the position of each order being entered by the route driver into the microprocessor 56 (as by an internal keyboard (not show)). Alternatively, as discussed below, the orders could be returned to any available position by the route driver, but with each order tagged with a readable identification code (such as a bar code), so that a scanner associated with the retrieval device 60 can scan all processed orders in the storage facility 14 and cause the recording in memory of the location of each customer's processed order.

As illustrated in FIG. 5, the example transaction record 68 can include the customer credit card number (optionally with name). It may include the date, time and outlet number, which will serve as a unique key or identifier for each transaction. As an aide in tracking, the transaction record may include the bag number, if a bag is issued for deposit of customer goods on drop-off, as in one embodiment of the present invention.

The transaction record 68 should also list the type of transaction (drop-off or pickup), and should include a listing of all garments and services requested by the customer on the customer input.

The transaction records 68, stored in memory for a period of time, are useful for providing a printout of daily transactions 64, or a modem communication of such a listing to the central plant 50, as well as for providing information necessary for the customer receipt and for tying to order in other appropriate ways for easy tracking of the order.

At the central processing plant 50, information from the transaction record, whether communicated over modem/telephone line or by being carried by the route driver as a list or by being inserted in each drop-off garment bag by the customer, is used to verify the order input by the customer and to provide basis for a billing in the form of a debiting of the customer's credit card account, if the listing of requested services is correct.

FIGS. 6A and 6B are a routine chart illustrating some aspects of the method and system of the invention. FIGS. 6A and 6B show interface with the customer at drop-off and pickup, including customer advice display sequences, customer input, and other aspects of customer drop-off and pickup sequences. They also show collection of orders by a route driver, processing of orders at the central plant, and return of processed orders to the remote outlet by the route driver.

Figure 7:
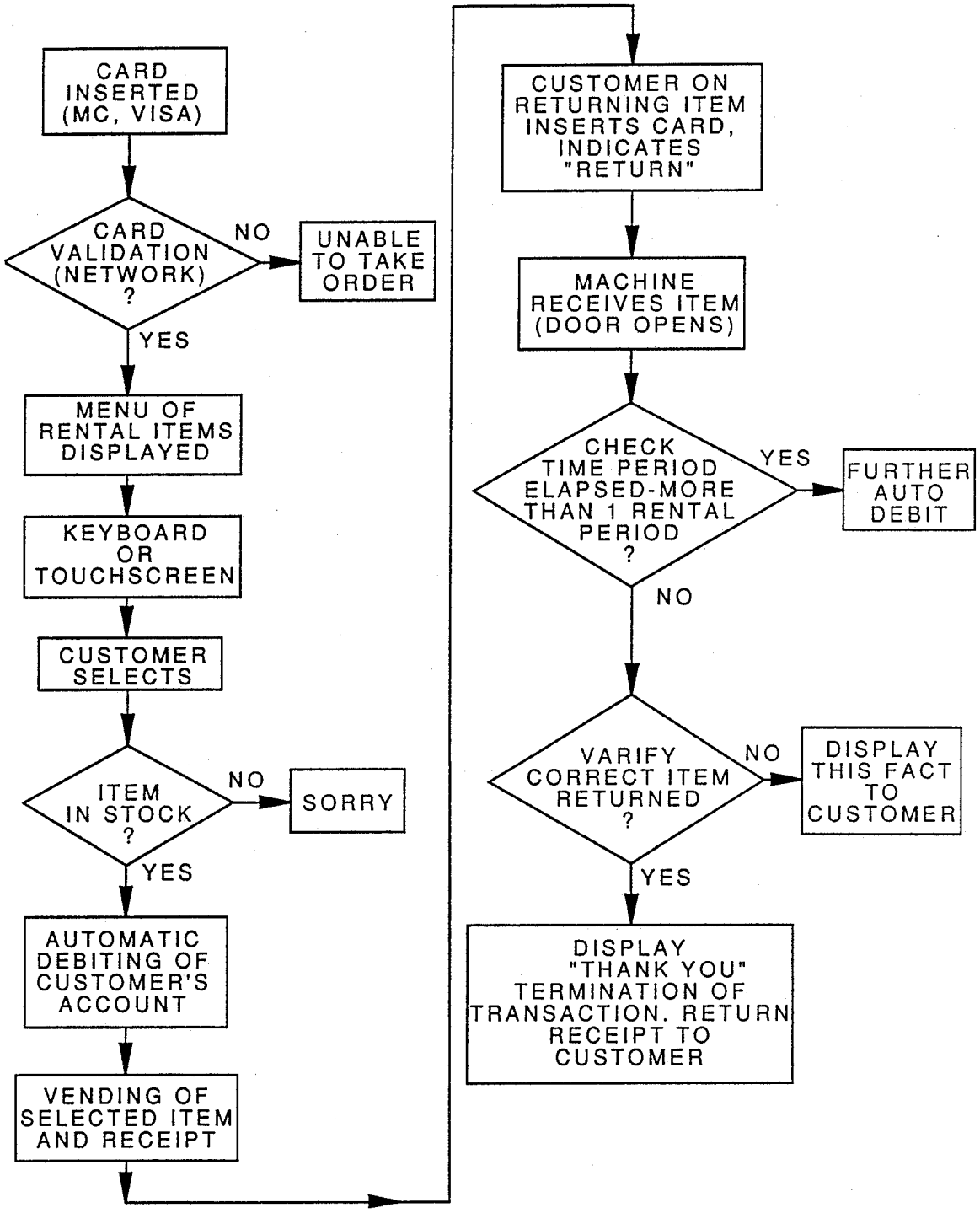
FIG. 7 is a diagrammatic sequence chart showing a pickup and drop-off customer interface system of the invention wherein stored items are rented to customers.

FIG. 7 shows in a diagrammatic sequence chart the basic elements of flow in a modified system according to the invention wherein stored items are rented to customers. In such a system, the pickup occurs first followed by the drop-off after the rental item has been used by the customer. As illustrated, after the user's credit card is inserted, the system may first check the validity of the card and availability fo credit for these services, through a computer, auto dialup and banking network. If the card is valid, the system will then display to the customer a menu of rental items available. A keyboard, touchscreen or other customer input devices enables the customer to make his selection.

If the item is in stock, the customer's credit card account is then electronically debited for the services based on one rental period (e.g., one day). The selected item is vended to the customer, along with a receipt showing the transaction and the charge to the customer's account.

When the customer returns the item he again inserts his card, whereupon the machine receives the item, as by opening a door. The system may include a check of the period of time elapsed, and if more than one rental period is involved, a further automatic debiting of the customer's account will occur. Also, the system may include an automatic verification that the correct item is being returned, as by a readable identification code placed indelibly on each item. If the correct item has been returned, the display can signify that the transaction is complete, and a return receipt can be issued to the customer.

Figure 8:
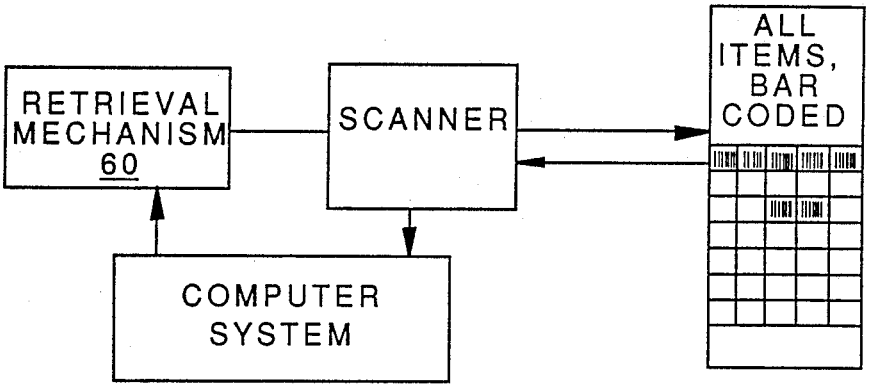
FIG. 8 is view diagrammatically indicating the use of a readable product identification code and scanner for locating items in the storage facility, as an alternative to location by storage position.

FIG. 8 is included to illustrate an alternative item locating means for all of the above described embodiments of the invention, wherein the positions of items in the storage facility are identified for retrieval not by being tagged to a storage position, but rather by a readable identification code (such as a bar code) attached to each item. As FIG. 8 illustrates a scanner which can be connected to the retrieval mechanism at some point will scan the items in the storage facility to identify locations. This can either be done in a search for a particular item, or it can be done when the machine is idle, e.g. just after the route driver has returned processed orders, with all items being scanned and their locations being recorded in memory. In this way, when a customer seeks to retrieve his processed order, the equipment can go immediately to the re-identified location to retrieve the order.

The above-described preferred embodiments illustrate the principles of the invention, but are not intended to limit the scope of the invention. Other embodiments and variations to these preferred embodiments will be apparent to those skilled in the art and may be made without departing from the scope of the invention as defined in the following claims.

We claim:

1. A system for automated drop-off and pickup of laundry and dry cleaning orders, remote from a central dry cleaning/laundry plant, for unattended use by customers, comprising:

a storage facility for garment bags, soiled garments of unprocessed orders and processed laundry/dry cleaning orders, including means for storing garment bags and processed orders in positions for retrieval, a customer interface panel at the front of the storage facility, retrieval means in the storage facility for retrieving a garment bag or a processed order upon receipt of an appropriate command, the customer interface panel including card reader means for reading encoded information on a customer's non-dedicated general purpose credit card, display means for presenting information and instructions to the customer, menu means for displaying to the customer a menu of services for selection for the customer's order, customer input means for enabling the customer to select desired services from the menu of services in accordance with the items the customer is dropping off, and printer means for printing and outputting to the customer a receipt reflecting the services selected by the customer on the customer input means, a door adjacent to the interface panel between the customer's position and the storage facility, including door opening and closing means, computer means including memory means, for issuing appropriate instructions to the customer on the display means after receiving information from the customer's credit card; for receiving the customer's input on the input means; for issuing a command to the retrieval means if the customer's order has been processed and placed in the storage means, to go to a particular storage position in the storage facility to retrieve the processed order and bring it to the door and open the door to enable the customer to remove the processed order; for creating and storing a transaction record of each transaction; and for driving the printer means and other functions.

2. The system of claim 1, wherein the computer means include means for generating and recording in memory a transaction record with a customer's drop-off order identified by the customer's credit card information and retaining the record of the customer's drop-off order in memory until the customer retrieves the processed order, and card-responsive means for searching memory for a dropped off order of a customer whenever that customer's credit card is inserted and read by the card reader means, and for (1) if the drop-off order has not been processed and returned to the storage facility, causing the display means to display a message that the order has not yet been completed, (2) if the drop-off order has been processed and returned, issuing a command to the retrieval means to retrieve the processed order from a storage position associated with that order, and to bring the order to the door and open the door to enable the customer to remove the processed order, and (3) if there is no drop-off order for this customer in memory, and the customer indicates this is a new order, causing the retrieval means to deliver a garment bag to the door and open the door to enable the customer to place his soiled garments in the bag for drop-off.

3. The system of claim 2, wherein the card-responsive means includes position-assigning means for, under condition (3), also associating the customer by his credit card information with a particular position in the storage facility not occupied by a processed order and retaining this position association in memory until the customer's processed order is picked up.

4. The system of claim 3, wherein the card-responsive means includes storage position scanning means for determining conditions (1) and (2) by scanning the particular position associated with the customer and determining whether a processed order is there.

5. The system of claim 1, wherein the display means includes a video monitor and means for displaying an instructional demonstration video program to a customer.

6. The system of claim 1, wherein the display means includes means connected to the customer input means for displaying the customer's selected order for services to the customer and for enabling the customer to enter or cancel the order before the receipt is printed by the printer means and output to the customer.

7. The system of claim 1, further including means associated with the customer input means and the display means for requesting the customer on drop-off to input his telephone number, for communication by the central plant with the customer if necessary.

8. The system of claim 1, further including the telephone means with rapid dialing means for dialing the telephone number of the central plant upon a telephone activation input by the customer, for customer communication with the central plant for problems, complaints and special requests.

9. The system of claim 8, wherein the telephone means includes download modem means for communicating with a computer at the central plant and downloading information from the memory means relating to all drop-off and pickup transactions for a preselected period upon receipt of a download command.

10. The system of claim 1, further including a daily transaction printout means connected to the computer means for printing out behind the interface panel a compilation of all drop-off and pickup transactions for a selected period of time, said compilation not being accessible to the customer.

11. The system of claim 1, wherein the card reader means comprises a magnetic strip card reader.

12. The system of claim 1, further including automatic debit means for automatically charging the customer's non-dedicated general purpose credit card account at the time of drop-off, based on the order for services as selected by the customer.

13. The system of claim 1, further including means for handling other, non-laundry/dry cleaning services, and said customer input means including means enabling the customer to select such other services and to drop off and pick up items corresponding to such other services.

14. A method for providing consumer laundry and dry cleaning services by customer interface at a plurality of automated, unattended machine facilities remote from and serviced by a central dry cleaning/laundry plant, comprising:

(1) providing the automated machine facilities at locations remote from the central plant and on a service route from the central plant, each machine facility having: a storage facility for garment bags, soiled garments of unprocessed drop-off orders, and processed laundry/dry cleaning orders for pickup; means for storing processed orders in positions for retrieval; retrieval means in the storage facility for retrieving a processed order upon receipt of an appropriate command; a customer interface panel at the front of the storage facility, including card reader means for reading encoded information on a customer's non-dedicated general purpose credit card, display means for presenting information and instructions to the customer, menu means for displaying to the customer a menu of services for selection for the customer's order, customer input means for enabling the customer to select desired services from the menu of services in accordance with the items the customer is dropping off, and printer means for printing and outputting to the customer a receipt reflecting the services selected by the customer on the customer input means; a door adjacent to the interface panel between the customer's position and the storage facility, including door opening and closing means; and computer means including memory means, for issuing appropriate instructions to the customer on the display means and for storing orders and position locations in memory and operating the retrieval means and processing information relative to the handling of a customer's order and all transactions with the customer;

(2) at each automated machine facility, performing the following steps for a customer:

(a) on the display, instructing the customer to insert a general purpose credit card for drop-off or pickup services, (b) automatically reading encoded information from the customer's credit card with the card reader means, (c) searching memory with the computer means for a record of an order previously dropped off by this customer by association with this credit card, (d) if a record is found of an order for this customer, but the order has not been processed and returned, informing the customer on the display that the order is not yet ready, (e) if a record is found of an order of the customer and the order has been processed and returned, automatically instructing the retrieval means to retrieve the processed order and bring it to the door and open the door with the order within the customer's reach so that the customer can take the processed order, (f) if the customer desires to leave a drop-off order, and no record is found of a drop-off order in process for this customer, delivering to the customer a drop-off garment bag and instructing the customer to place items for processing in the drop-off bag, and instructing the customer on the display to select and input the order on the customer input means, as to what garments are placed in the drop-off bag and what services are being selected from the menu of services, and placing the bag with the garments in the storage facility for later pickup by a route driver, (g) creating a computer record of the transaction which has occurred, including a record that a processed order has been picked up if that is the case, or a record that a new drop-off order has been taken if that is the case, and, if a drop-off order, printing out a receipt for the customer to take, reflecting the customer's order as input by the customer on the input means;

(3) manually collecting drop-off orders from the machine facilities by a route driver who travels between the central dry cleaning/laundry plant and the machine facilities, and at the same time bringing processed orders from the central plant and placing them in the storage facility each at an assigned position for later retrieval by the retrieval means, and delivering the drop-off orders to the central plant;

(4) communicating a record of the contents of each drop-off order as input by the customer, to the central plant;

(5) at the central plant, checking the contents of each drop-off bag against the record of what the customer has input as his order;

(6) at the central plant, processing the drop-off orders and packaging them for return to the automated machine facilities; and (7) manually delivering the completed, processed orders to each respective automated machine faciility using the route driver, who repeats step (3) for each automated machine facility on his route.

15. The method of claim 4, wherein step (2)(f) includes creating and storing in memory a storage facility position association with the customer's credit card identification, and retaining the association until the customer picks up the processed order, so that a storage position is reserved for that customer and is associated with that customer from drop-off until pickup, and wherein step (2)(e) includes instructing the retrieval means to go to the associated position to retrieve the processed order, and wherein step (3) includes the route driver's placing each of the processed orders at the respective associated position, as identified on a receipt with the processed order, and including deleting the position/customer association upon a customer's pickup of his processed order.

16. The method of claim 14, further including providing telephone means with automatic dialup means at the automated machine faciliteis for customer communication with the central dry cleaning/laundry plant for problems, complaints and special requests, and including instructing the customer to activate the telephone means to call the central plant by entering an instruction, in the event of such problems, complaints and special requests.

17. The method of claim 14, further including in step (2)(g), creating with the record an association between the customer's credit card indentification and a bag number of a bag issued to the customer, so that the customer's order can be tracked by bag number as well as by customer credit identification and by transaction record.

18. The method of claim 14, further including recording with the computer transaction record the date, time and identification of the particular automated machine facility for each transaction with a customer.

19. The method of claim 14, further including, on reading a customer's credit card, requesting the customer on the display to indicate with the customer input means whether he intends to pick up an existing order or drop off a new order.

20. The method of claim 14, further including in step (2)(g), creating with the computer transaction record an association between the customer's credit card information and a particular position in the storage facility, and issuing a garment bag from that storage position to the customer.

21. The method of claim 20, further including creating with the transaction record an association between the customer's credit card information and a bag number of the garment bag issued to the customer.

22. The method of claim 14, wherein the communicating step of step (4) comprises the route driver's delivering to the central plant with each garment bag a record of the contents of each drop-off order as input by the customer and as collected by the route driver with each garment bag.

23. The method of claim 22, further including communicating the record of each customer drop-off order via the computer means and a telephone line and modem, to a central computer at the central plant.

24. The method of claim 22, further including automatically instructing the customer on drop-off to place a copy of the customer receipt/transaction record in the garment bag with his soiled garments.

25. The method of claim 14, further including in step (2), displaying a request to the customer to input his telephone number on the customer input means, and storing the telephone number in memory and communicating it to the central plant, in case of problems with the order discovered at the central plant.

26. In a system for rendering services for customers involving drop-off and pickup of items by the customer, a customer interface outlet for automated, attendant-free customer interface, comprising:

a storage facility for storing securely a large number of different items to be dispensed to customers, an interactive customer interface panel connected to the storage facility, including card reader means for reading encoded information from a customer's non-dedicated general purpose credit card, display means for presenting information and instructions to the customer, menu means for displaying to the customer a menu listing of services for selection by the customer, customer input means for enabling the customer to select desired services from the menu of services, and printer means for printing and outputting to the customer a receipt reflecting the services selected by the customer on the customer input means, retrieval means in the storage facility for retrieving an item selected by the customer upon receipt of an appropriate command, a door in the customer interface panel between the customer's position and the storage facility, including door opening and closing means, and computer means comprising a general purpose computer and a memory, for issuing appropriate instructions and information to the customer on the display means after receiving information from the customer's credit card; for receiving the customer's input on the customer input means, for issuing a command to the retrieval means to retrieve the customer's order from the storage facility; and for creating and storing in memory a transaction record of each transaction with a customer, including drop-off and pickup by the customer, identifying the customer by credit card information, and for driving the printer means including printing said customer receipts based on the transaction record.

27. A system according to claim 26, further including telephone means with modem means and auto dialer means, for networking the customer interface outlet via the computer means with a control center for exchange of information between the control center and the customer interface outlet, including communication of the transaction records from the customer interface outlet to the control center.

28. A system according to claim 27, wherein the services are laundry/dry cleaning services, the control center comprising a central laundry/dry cleaning processing plant, and wherein the items to be dispensed to customers are processed customer garments.

29. A system according to claim 28, wherein the telephone means includes customer to plant communication means for enabling the customer to call up the central laundry/dry cleaning processing plant using the auto dialer means by the pressing of a button, for discussing problems, complaints and special requests.

30. A system according to claim 27, wherein the telephone means includes customer to control center communication means for enabling the customer to call up the control center using the auto dialer by the pressing of a button on the customer interface panel, for discussing problems and complaints.

31. A system according to claim 26, wherein computer means further includes automatic debiting means for creating a debit against the customer's general purpose credit card account for the services selected.

32. A system according to claim 31, further including automatic card verification means associated with the card reader means and the computer means for automatically verifying the validity of a customer's credit card for the services selected, and including a telephone line and modem means and auto dialer means connected to the computer means, for communication over the telephone line with a credit card verification center for said verification of card validity.

33. A system according to claim 26, wherein the services are rental services for renting to customers a variety of items in the storage facility, and including item locator means for identifying the location of a selected item in the storage facility to enable retrieval of the item by the retrieval means.

34. A system according to claim 33, wherein the item locator means comprises means assigning a position location in the storge facility for each item offered and for retaining in the memory an association between each item and its respective position location, so that the computer means can issue a command to the retrieval means to go to a particular position in the storage facility to retrieve an item selected by the customer on the customer input means.

35. A system according to claim 33, wherein the item locator means comprises a readable identification code on each item held for rental in the storage means, and a code scanner means associated with the retrieval means for scanning the identification codes of items in the storage facility until a selected item is found.

36. A system according to claim 35, further including return item verification means for again scanning the returned rental item with the code scanner on the customer's return of the item to verify that the correct item is being returned.

37. A system according to claim 35, wherein the readable identification code is a bar code.

38. A system according to claim 26, further including item locator means associated with the retrieval means and the computer means, for identifying the location of an item to be picked up by the customer to enable retrieval of the item by the retrieval means.

39. A system according to claim 38, wherein the item locator means comprises a readable identification code on each item held in the storage facility for pickup by customers, and a code scanner means associated with the retrieval means for scanning the identification codes of items in the storage facility until an item to be picked up by the customer is found.

* * * * *